US006401418B1

(12) United States Patent
Senn et al.

(10) Patent No.: US 6,401,418 B1
(45) Date of Patent: Jun. 11, 2002

(54) COVING METHOD FOR TUBS AND SHOWERS

(75) Inventors: Joseph M. Senn, Murphys, CA (US); Anthony J. Senn, Boise, ID (US)

(73) Assignee: Sierra Technology, LLC, Boise, ID (US)

( * ) Notice: Subject to any disclaimer, the term of this patent is extended or adjusted under 35 U.S.C. 154(b) by 0 days.

(21) Appl. No.: 09/439,729

(22) Filed: Nov. 12, 1999

(51) Int. Cl.[7] ..... E04B 1/68; E04B 1/684

(52) U.S. Cl. ..... 52/506.01; 52/35; 52/58; 52/287.1; 52/716.2

(58) Field of Search ..... 52/403.1, 35, 58, 52/716.2, 506.01, 287.1, 288.1

(56) References Cited

U.S. PATENT DOCUMENTS 1,555,392 A * 9/1925 Tracy et al. ..... 52/287.1
1,739,077 A * 12/1929 Iisher et al. ..... 52/288.1
2,069,289 A * 2/1937 Swendsen et al. ..... 52/288.1
3,192,576 A * 7/1965 Wieting ..... 20/74
3,475,871 A * 11/1969 Saunders et al. ..... 52/287.1
4,601,149 A 7/1986 Dokan
4,706,427 A 11/1987 Zeilinger
4,760,681 A 8/1988 Harrison
4,837,997 A 6/1989 Zeilinger
5,010,703 A 4/1991 Pearlman et al.
5,287,667 A 2/1994 Singhal
5,553,431 A 9/1996 Pelosi, Jr. et al.
6,108,981 A * 8/2000 Sama et al. ..... 52/60
6,282,855 B1 * 9/2001 Shipton ..... 52/287.1

* cited by examiner

*Primary Examiner*—Carl D. Friedman
*Assistant Examiner*—Phi Dieu Tran A
(74) *Attorney, Agent, or Firm*—Robert L. Shaver; Frank J. Dykas; Stephen M. Nipper

(57) ABSTRACT

A method of installing flooring to a bathroom floor which utilizes a coving cap attached to a bathtub wall or shower enclosure, to form a waterproof and flexible seal. The edge of the flooring material is inserted into an inverted "J" shaped coving cap, which traps the edge of the flooring, but allows it to move up and down slightly. The corners of the flooring are mitered and sealed to form a waterproof corner, and the entire floor becomes a waterproof basin.

8 Claims, 4 Drawing Sheets

COVING METHOD FOR TUBS AND SHOWERS

BACKGROUND OF THE INVENTION

Field of the Invention

The present invention generally relates to methods of installing flooring, and more particularly to a method of installing flooring in bathrooms and adjacent to bathroom fixtures such as bathtubs and shower enclosures.

Background Information

It is a common practice in the flooring industry, when installing vinyl or other types of flooring in a bathroom, to partially cove the flooring. This is done by installing a coving cap which is roughly J-shaped in cross section along the wall of the bathroom near the floor. The vinyl flooring is ramped up the wall a few inches and secured in the channel of the cove cap. The coved flooring is used in place of baseboards and other types of trim. In a coved installation of this type, where the vinyl flooring is adjacent to the side of a bathroom fixture such as a bathtub or shower enclosure, the vinyl or other flooring is trimmed so that it lays flat on the floor and butts against the side of the bathtub or shower enclosure. A bead of caulking, such as silicone, is placed along the edge where the vinyl flooring butts against the bathtub or shower enclosure.

This forms a waterproof seal and would seem to offer the installer an easy and inexpensive way to seal the edges of the vinyl floor. Over time, however, the tub and floor will flex relative to each other and ultimately the caulking seal will be broken. What is worse, the breach in the seal will not be obvious and may go unnoticed for many years. During this time water will penetrate under the flooring and into the bare wood floor framing. The source of the water can be from people stepping out of the bathtub/shower, splashing, ineffective shower curtains, leaking shower doors, mopping the floor, toilet overflow and other causes. Over the years, the wood under the flooring will rot and the floor will degrade structurally and cosmetically. Ultimately, costly remodeling work is required to correct the problem.

Accordingly, it is an object of the invention to provide a method of joining vinyl or other flooring in a bathroom to the edge of bathroom fixtures, such as bathtubs or shower enclosures, so that a waterproof basin is formed, which prevents water from penetrating into the wood under the flooring and allows the bathroom fixture to move relative to the bathroom floor without breaking the seal.

Additional objects, advantages and novel features of the invention will be set forth in part in the description as follows, and in part will become apparent to those skilled in the art upon examination of the following, or may be learned by practice of the invention. The objects and advantages of the invention may be realized and attained by means of the instrumentalities and combinations particularly pointed out in the appended claims.

SUMMARY OF THE INVENTION

These and other objects and advantages are attained by the method of the invention, which is a method of joining bathroom flooring material to the walls and fixtures of a bathroom. The fixtures may include the sides of bathtubs, shower enclosures, cabinets, counters, and other structures which form a wall which is essentially perpendicular to the floor of the bathroom. The purpose of the invention is to form a leak-proof and permanent coved joint, for leak-proof floor edges.

The method of the invention includes the first step of attaching a coving cap to the bathroom walls and fixtures. The coving cap is attached several inches from the floor, and basically takes the place of molding. The coving cap is typically a piece of extruded aluminum or other material which may be molded into the wall of the bathroom fixture, or which may be attached in a separate step using a means of attachment. The means attachment can be a strip of doublesided tape, a bead of adhesive, chemically or thermally melted adhesive, epoxy, or any conventional means of attachment. The coving cap is basically J-shaped in cross section and is mounted so that the "J" is upside down. The features of the coving cap cross section include a bead surface which is mounted uppermost, a face surface which is perpendicular or normal to the bead surface, and a channel portion which is formed by the J-shape. The bead surface is normal to the wall or the wall of the fixture, and later in the installation, a bead of caulking will be applied to the inner section of the bead surface and the bathroom wall or fixture wall. The face surface of the coving cap faces away from the center of the room, and toward the bathroom wall or fixture wall. Adhesive is placed on the face surface for securing the coving cap to the bathroom fixture.

The next step in the process is attaching a coving stick to the bathroom floor at the intersection of the bathroom wall, and the fixture wall. The bathroom wall and the fixture wall form an intersection which is essentially a 90° angle where they join. The coving stick is attached at this intersection by a means of attachment. The means of attachment can be by the use of an adhesive, by tacking or nailing, by heat or spot welding, by gluing or by other conventional means of attachment. The coving stick is a form which can take a number of shapes, each of which has a semicircular side which is adjacent to the curve of the vinyl flooring, and a corner side, which conforms to the angles of the intersection of the walls and floor.

The next step in the method is to apply vinyl or other flooring material to the bathroom floor and trimming the flooring to shape so that a portion of the flooring extends beyond the edge of the floor and turns vertically up the side of the bathroom walls and the fixture walls, and past the coving cap.

The next step is trimming the flooring material so that an edge of the flooring material is cut to an appropriate length for insertion into the channel portion of the coving cap. Next, the edge of the flooring material is inserted into the channel portion of the coving cap. The edge of the flooring material is thus inserted into the coving cap all around the entire perimeter of the bathroom floor. At the corners of the bathroom floor, the flooring material is cut so that it forms a mitered corner, with all the edges being inserted into the channel portion of coving cap. The edges of the mitered corner are sealed together, using heat, glue or caulking sealant, or a trim piece to form a waterproof mitered corner. The edge of the flooring material is not glued or secured in the channel portion of the coving cap, but is trapped in the channel portion. As the floor moves up and down in relation to the walls and the fixture wall of the bathtub or shower enclosure, the edge of the flooring material is free to move up and down in the channel portion of the coving cap. A bead of silicone or other waterproof caulking is placed on the bead edge of the coving cap, and forms a waterproof seal between the bathroom wall or the fixture wall, and the coving cap. This is to prevent the ponding of water droplets on the bead surface.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1:
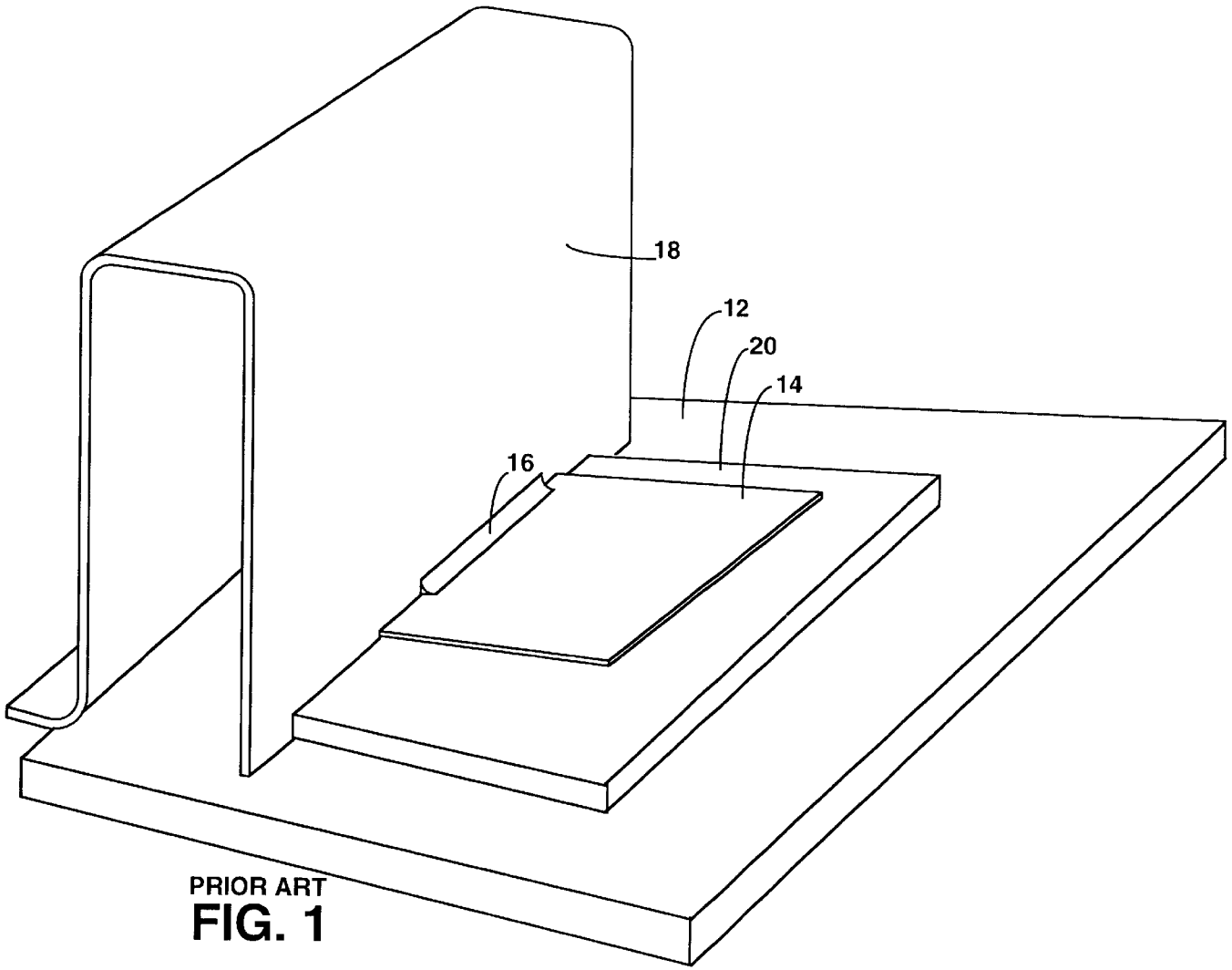
PRIOR ART FIG. 1
FIG. 1 is a perspective view of a prior art bathroom vinyl floor installation.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

A typical prior art installation of flooring material on a bathroom floor is shown in FIG. 1. This shows a subfloor 12 which is typically plywood. The subfloor rests on the floor of the room which may be concrete or wooden floor joists. On the subfloor 12 is located a layer of underlayment 20, which is typically particle board. On top of the underlayment, a layer of flooring 14 is laid. This may be vinyl flooring, linoleum, or other types of flooring that is flexible enough to turn from the floor up the side of the wall or bathroom fixture. FIG. 1 shows a tub side wall 18. Where the flooring 14 butts against the bathtub side wall 18, a caulking bead 16 forms a waterproof seal between the two.

Although this installation appears to present a waterproof seal which would prevent water from reaching the subfloor 12 or the underlayment 20, in reality this is a very imperfect seal. Many types of flooring are received on the job site in a roll, and have developed a natural curl when on the roll. The flooring is rolled off the larger roll and laid out flat on the floor. However, the tendency is still present for the vinyl flooring to curl up. This tendency to curl may itself break the seal where the vinyl flooring is sealed against the tub side wall 18. Additionally, over years of use, the floor will move relative to the tub side wall 18, or a shower enclosure. When this happens, the caulking bead 16 may be broken or loosened. With such a compromised seal, water will penetrate under the flooring and into the bare wood floor framing.

The invention solves this problem by eliminating the weak joint which is shown in FIG. 1 and replacing it with a coved joint which allows the floor to move relative to the bathtub and not break the seal.

Figure 2:
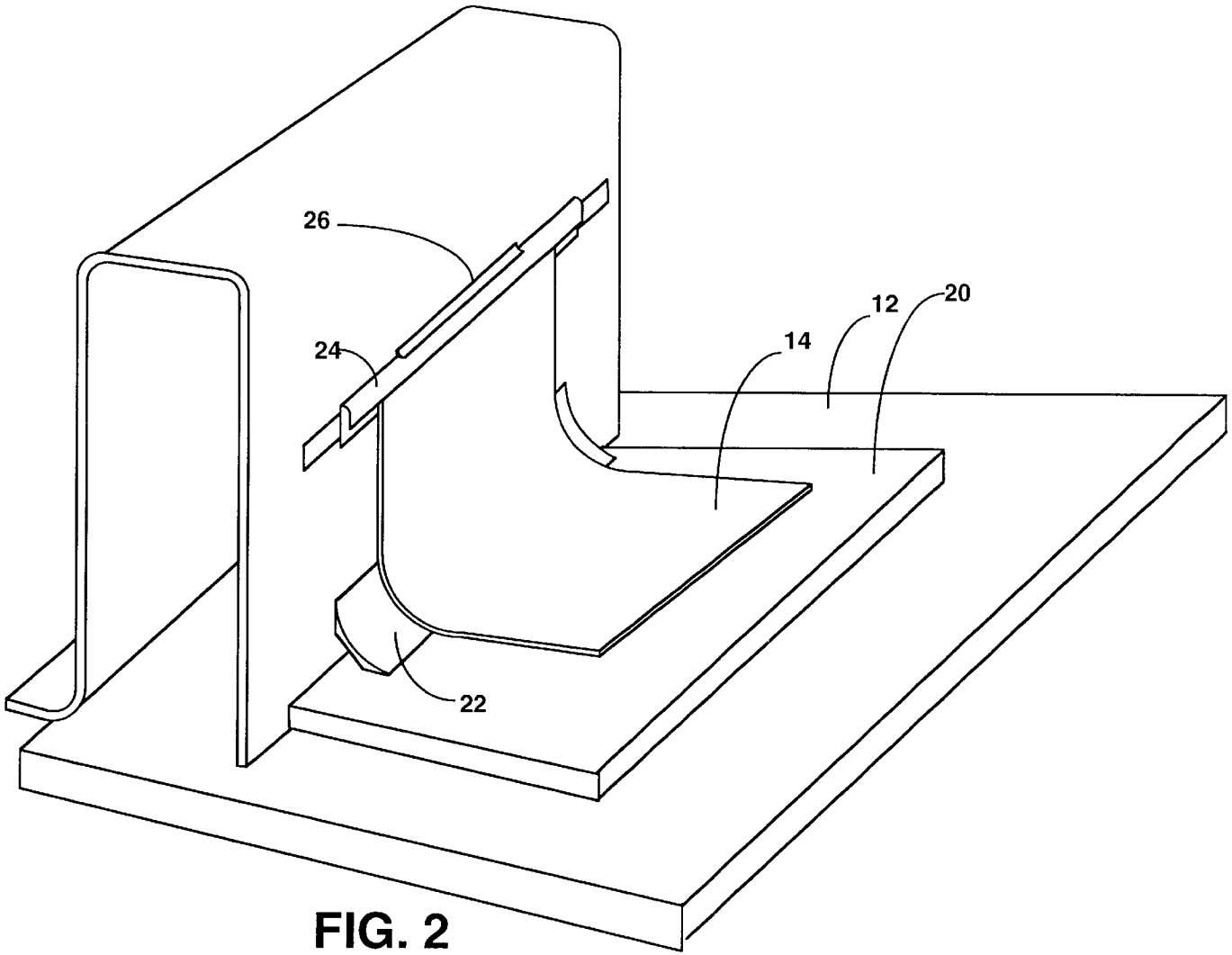
FIG. 2 is a perspective view of a bathroom vinyl floor installation of the invention.

FIG. 2 shows a view of an installation of flooring according to the method of the invention. FIG. 2 includes a subfloor 12, underlayment 20, and flooring 14, which would typically be vinyl or linoleum or other flexible flooring. It also includes a coving stick 22, a cove cap 24, and a caulking bead 26. Coving is when the vinyl flooring is ramped up the wall a few inches and secured under a cove cap. In current installations, it is not uncommon for floors to be coved, but only where the vinyl floor meets the edges of the wall and wood cabinets. Vinyl floors are not coved where they meet the edges of tubs, r shower enclosures, metal cabinets, or other wood surfaces. This invention is a method for allowing vinyl floors to be coved along the sides of tubs and shower enclosures and other similar bathroom fixtures, and joining that coving with the coving which is now typically done along the walls and cabinets. It also has waterproof mitered corners. This results in a floor which is essentially a waterproof basin several inches deep, which prevents water from penetrating into the subfloor, underlayment, or structure below. The cove cap 24 shown in FIG. 2 is attached to the tub side wall 18.

Figure 3:
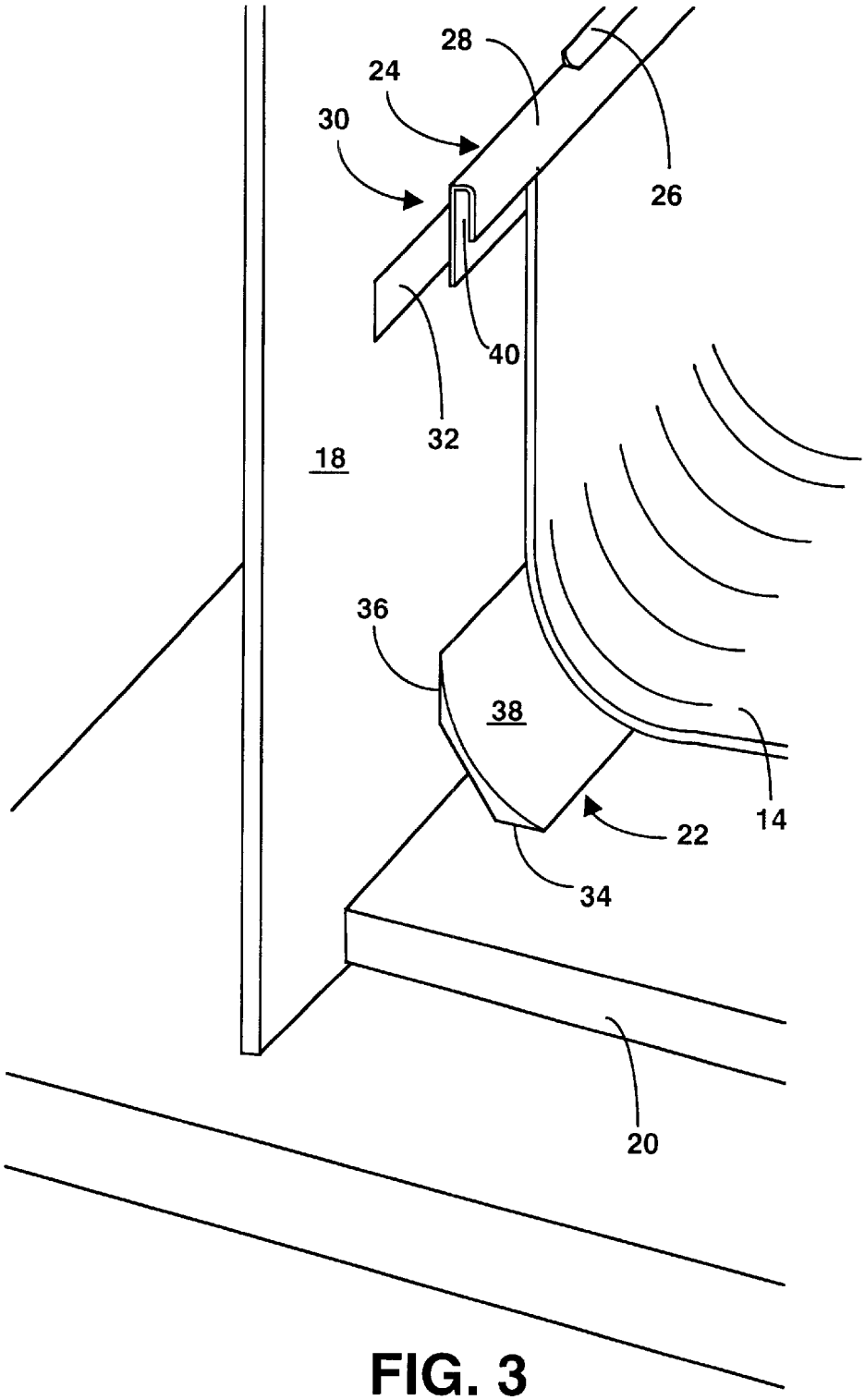
FIG. 3 is a perspective and detailed up view of a vinyl floor installation of the invention.
Figure 4:
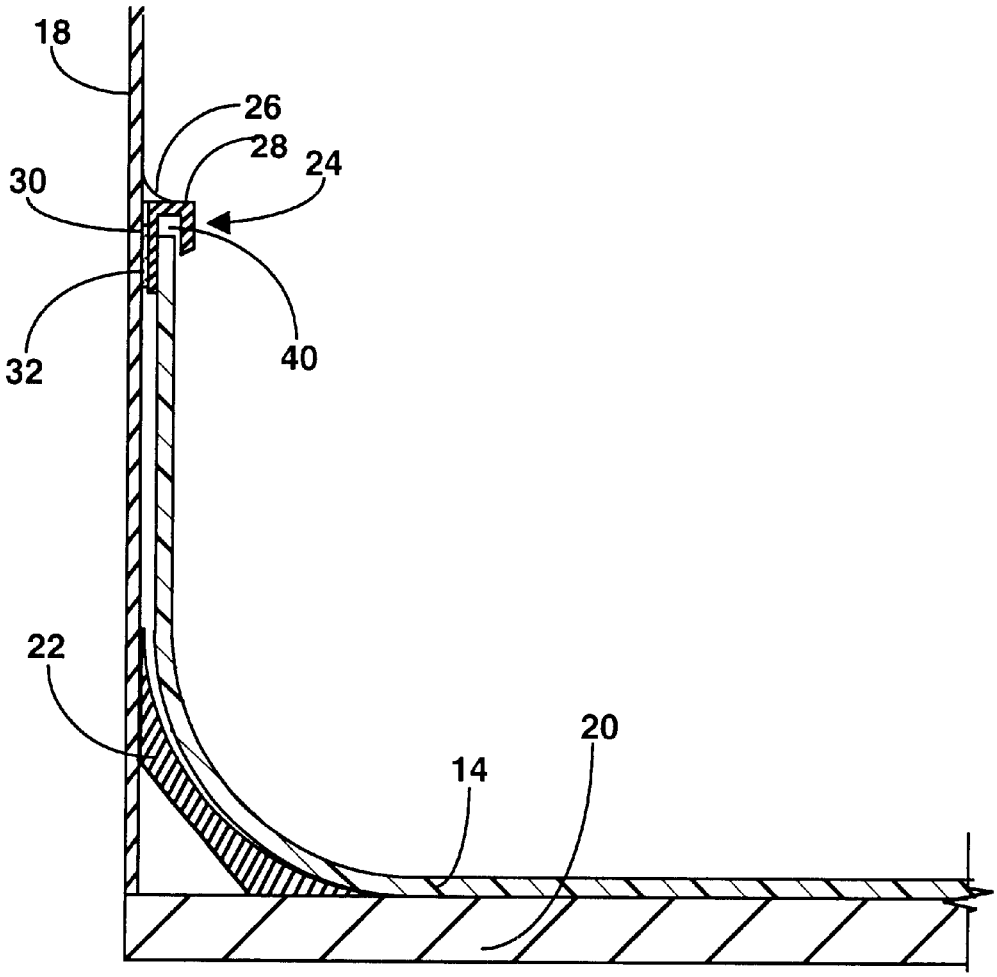
FIG. 4 is a cross sectional side view of a vinyl floor bathroom installation of the invention.

The cove cap is a piece which is typically extruded aluminum, but may also be other suitable materials such as other metals or plastic. It has a "J" shape in cross-section as shown in FIG. 3 and 4, and is mounted so that the "J" is inverted. The cove cap 24 includes a bead surface 28 and a face surface 30. The face surface 30 typically will include an adhesive strip 32 which attaches the cove cap 24 to the bathtub side wall 18. Although the adhesive strip 32 will typically serve as the means of attachment of the cove cap 24 to the bathtub side wall 18, various other means of attachment may be utilized. The cove cap 24 may be molded into the bathtub side wall itself. Alternately, the cove cap 24 may be attached using a variety of adhesive means, or by the use of glue, spot welding, thermally melted glue, or by screwing, bolting, riveting, or other conventional means of attachment.

The method also utilizes a coving stick 22. The coving stick 22 has one side which is curved or semicircular, and which supports the curve of the vinyl flooring as it goes from the horizontal of the floor to the vertical on the bathtub side wall. It also has a floor side 34 and a tub side 36 which contact the floor and the side of the tub, respectively. The coving stick 22 holds the uniform radius in the vinyl flooring, and provides backing structure and support to the vinyl flooring, to prevent tearing or punctures of vinyl flooring if some one steps on the curved portion of the vinyl flooring. One embodiment is shown in the drawings, but other embodiments can be possible, which form to the shape of the corner of the flooring, and which provides support to the flooring. A strip of curved sheet metal may be used, or semisolid grout may be molded in place. Foam may be injected into the space under the corner of the flooring to form a coving stick. A coving stick may also be built into the wall of the tub or shower enclosure.

To practice the method of the invention, the following steps are performed: A means of attachment such as those described above are used to attach a coving cap 24 to the bathroom walls and the sides of bathroom fixtures such as tubs and showers enclosures. Next a coving stick 22 is attached to the floor, usually by being tack nailed, at the intersection of the bathroom floor and walls, cabinets and fixtures. The coving stick 22 is a form with a semicircular side 38, as shown in FIGS. 3 and 4. Next, flooring material is cut to the approximate shape of the bathroom floor with an additional amount left over for each of the edges to extend partially up the bathroom wall or the fixture wall. Next the vinyl flooring is glued to the floor only, and the edges are trim cut and inserted into the cove cap 24. It is possible to skip the glueing step in some cases, and have the flooring held in place by the cove cap. The edges of the flooring 14 are thus trapped in the channel portion 40 of the cove cap 24. As shown in FIG. 4, the edge of the flooring 14 is left with a slight spacing inside the channel portion 40 of the cove cap 24. The vinyl flooring 14 is not glued to the sides of the wall or to the sides of the fixtures, but is left free to move up and down with relative movement and thermal expansion of the two.

One method of attaching the cove cap 24 to the bathtub side wall 18 is by use of a high quality double sided tape such as the types used to fasten automotive trim to vehicles. It is the fairly recent introduction of material such as this which has made this invention possible. Adhesive glue could also be used. A snap-in connection between the cove cap 24 and bathtub side wall 18 would also be possible if bathtubs were manufactured with the appropriate fitting for a snap-fit, or if a groove were created by a tool such as a router bit for that purpose. The cove cap may be molded into the tub or shower wall, by forming in the case of plastic, or by casting in the case of metal fixtures.

Another step in this process is the application of a caulking bead 26 to the bead surface 28 of the cove cap 24. This caulking bead 26 is shown in FIGS. 2, 3 and 4. The corners of the vinyl flooring are trimmed to form mitered corners in which the mitered edges are sealed to be waterproof.

The result of practicing this method is the creation of a waterproof basin on the floor of a typical bathroom, which will protect the underlying components of the floor from leakage of water from the tub or shower as long as the vinyl flooring remains waterproof. This basin will remain waterproof much longer than the prior art seal was waterproof, due to the failure of the joint at the edge of the bathtub side wall 18.

This is especially important since some glues used in the manufacture of particle board, oriented strand board, and plywood are water soluble. An important feature of an installation performed by this method is that the seal between the vinyl floor and the tub is "compliant". This means that the joint takes into account the reality that the bathroom floor and the tub or shower enclosure are bound to move relative to each other, and the seal allowing this must remain waterproof while allowing this movement. With this kind of installation, the vinyl flooring is not physically attached to the cove cap nor to the fixture wall, which allows a "slip fit" joint. Another result of this installation is that the flooring installation is cosmetically appealing because all the walls in the bathroom can be coved, rather than just those adjacent to framed walls. Because the joint is a "slip fit" joint, it also accounts for thermal contraction and expansion of the flooring and the tub and shower enclosure, as well as possible "shrinkage" or expansion of the vinyl flooring. It also counteracts the tendency of the vinyl flooring to curl back into its cylindrical shape. This installation will result in lower maintenance since it will be easier to keep clean. A small bead of caulking 26 added to the top of the cove cap 24 serves to shed water and prevent ponding of water on top of the cove cap 24. Since the coving of the installation replaces base boards, it presents a vinyl flooring surface which can be easily cleaned with a mop at the same time the floor is being cleaned. The perpendicular joint of baseboard does not support this kind of simultaneous cleaning. Since water is kept on top of the vinyl flooring, the vinyl flooring will not tend to delaminate from the underlayment, one problem water leakages cause in present installations.

While there is shown and described the present preferred embodiment of the invention, it is to be distinctly understood that this invention is not limited thereto but may be variously embodied to practice within the scope of the following claims.

From the foregoing description, it will be apparent that various changes may be made without departing from the spirit and scope of the invention as defined by the following claims.

We claim:

1. A method of joining flooring material, for use on bathroom floors, to bathroom tub and shower fixtures, in a leakproof and permanent coved joint, comprising the steps of:

attaching a coving cap to said bathroom tub and shower fixtures by a non-penetrating bonding attachment, in which said coving cap comprises a bead surface, a face surface normal to said bead surface, and a channel portion which is "J" shaped in cross section;

attaching a coving stick to said bathroom floor at an intersection of said fixtures and said floor, said coving stick comprising a form with a semicircular side which faces away from said intersection, and a corner side with edge surfaces which conform with planes of said intersection;

applying flooring material to said bathroom floor so that a portion of said flooring material extends beyond said floor edge and extends vertically up said bathroom fixtures, and past said coving cap;

trimming said flooring material so that an edge of said flooring material may be inserted in said channel portion of said coving cap;

inserting an edge of said flooring material into said channel portion of said coving cap so that said edge of flooring material is contained within said channel portion, and does not completely fill said channel portion, leaving a zone for movement of said flooring material in said channel portion;

wherein said edge of said flooring material in said channel portion is trapped in said channel portion, but may move up and down in said channel portion as said fixture moves in relation to said floor, and in which said flooring material forms a waterproof joint between said fixture and said bathroom floor.

2. The method of joining bathroom flooring material to bathroom fixtures of claim 1 which further comprises the step of forming sealed mitered corners of said flooring material at corners of said bathroom, thus forming a waterproof basin on said bathroom floor.

3. The method of joining bathroom flooring material to bathroom fixtures of claim 1 which further comprises the step of glueing the flooring material to bathroom floor.

4. The method of joining bathroom flooring material to bathroom tub and shower fixtures of claim 1 in which the step of attaching said coving cap to the side of said bathroom fixture comprises molding said coving cap into said tub or shower fixture.

5. The method of joining bathroom flooring material to bathroom walls and fixtures of claim 1 which further comprises the step of attaching the coving cap to a bath tub or shower enclosure after manufacture of the bath tub or shower enclose.

6. The method of joining bathroom flooring material to bathroom fixtures of claim 1 which further comprises the step of attaching said coving cap to said walls and fixtures using an adhesive.

7. The method of joining bathroom flooring material to bathroom tub and shower fixtures of claim 1 which further comprises the step of using double sided adhesive tape as said means of attachment for attaching said coving cap to said tub and shower bathroom fixture.

8. The method of joining bathroom flooring material to bathroom tub and shower fixtures of claim 1 which further comprises the step of attaching a coving cap of metal or plastic to said bathroom wall and said bathroom fixture.

* * * * *